US007802373B1

(12) United States Patent
Diesterheft

(10) Patent No.: US 7,802,373 B1
(45) Date of Patent: Sep. 28, 2010

(54) PUTTER SHAFT/HEAD DESIGNING SYSTEM

(76) Inventor: Richard W. Diesterheft, 6425 Shoreline Dr., #10105, St. Petersburg, FL (US) 33708

( * ) Notice: Subject to any disclaimer, the term of this patent is extended or adjusted under 35 U.S.C. 154(b) by 0 days.

(21) Appl. No.: 12/462,509

(22) Filed: Aug. 5, 2009

(51) Int. Cl.
*A63B 69/36* (2006.01)

(52) U.S. Cl. ..... 33/508; 33/534

(58) Field of Classification Search ..... 33/508, 33/342, 343, 424, 679.1, 534; 473/219, 231, 473/296

See application file for complete search history.

(56) References Cited

U.S. PATENT DOCUMENTS 4,104,802 A * 8/1978 Johnston ..... 33/508
D342,558 S * 12/1993 Diesterheft ..... D21/741
5,722,177 A * 3/1998 Reilly, III ..... 33/508
5,782,005 A * 7/1998 Reilly, III ..... 33/508
6,623,372 B1 * 9/2003 Beebe et al. ..... 473/231
6,754,970 B2 * 6/2004 Daniels ..... 33/508
6,799,377 B2 * 10/2004 Sones ..... 33/508
D523,510 S * 6/2006 Hicks ..... D21/789
7,172,513 B1 * 2/2007 Rinker ..... 473/219
7,513,060 B2 * 4/2009 Souza et al. ..... 33/508
7,614,961 B2 * 11/2009 Schmutz ..... 473/257
2008/0178483 A1 * 7/2008 Souza et al. ..... 33/508
2009/0227388 A1 * 9/2009 Schmutz ..... 473/240

* cited by examiner

*Primary Examiner*—Yaritza Guadalupe-McCall

(57) ABSTRACT

A shaft has upper and lower ends and an intermediate extent. A putter head simulator includes a horizontal lower plate having upper and lower surfaces, a mirror attached to the upper surface of the lower plate, and a vertical coupling plate extending upwardly from the upper surface of the lower plate. An angular adjustment assembly is for varying the angular relationship between the shaft and the simulator. A shaft length adjusting assembly is for varying the length of the shaft.

3 Claims, 2 Drawing Sheets

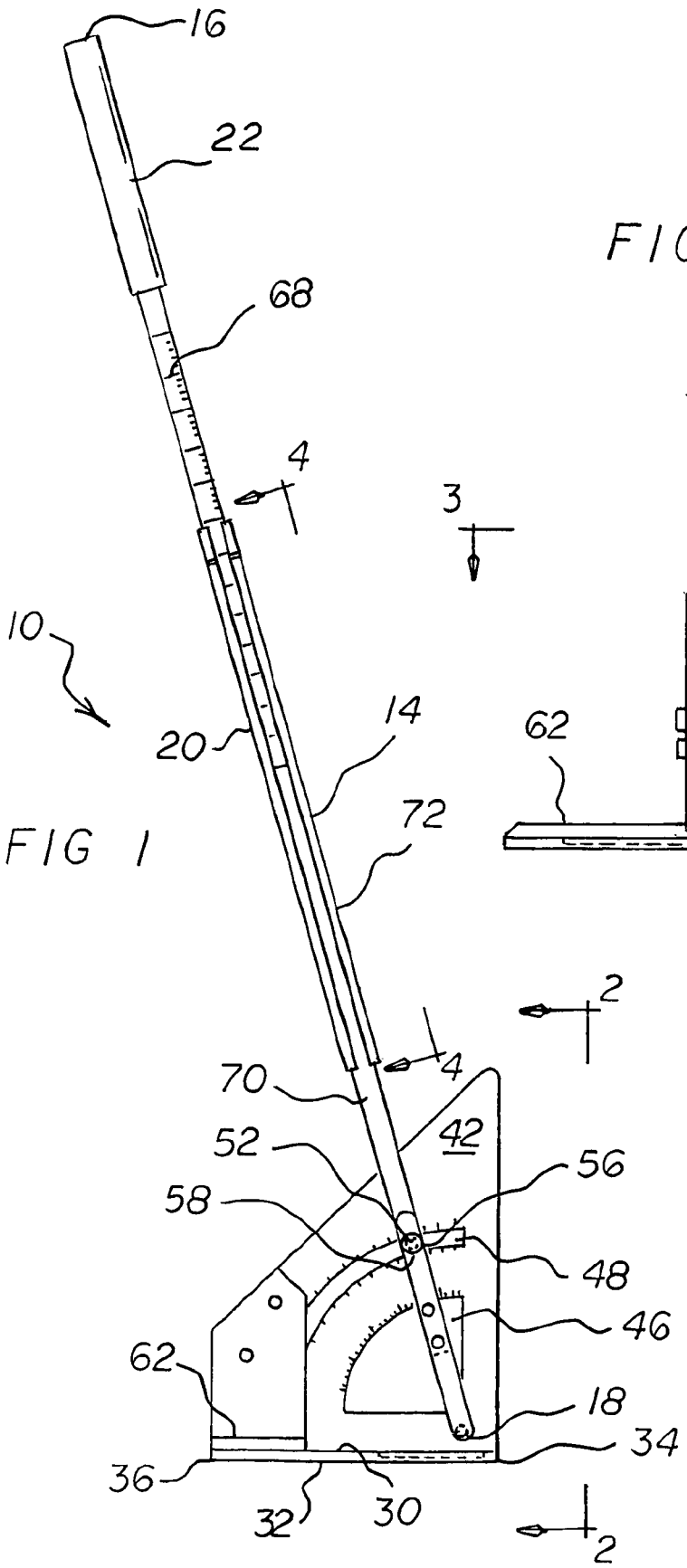
FIG 1
FIG 2
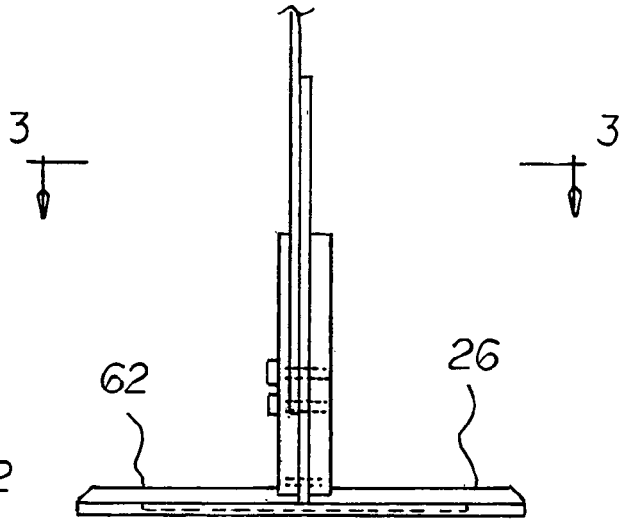

FIG 3
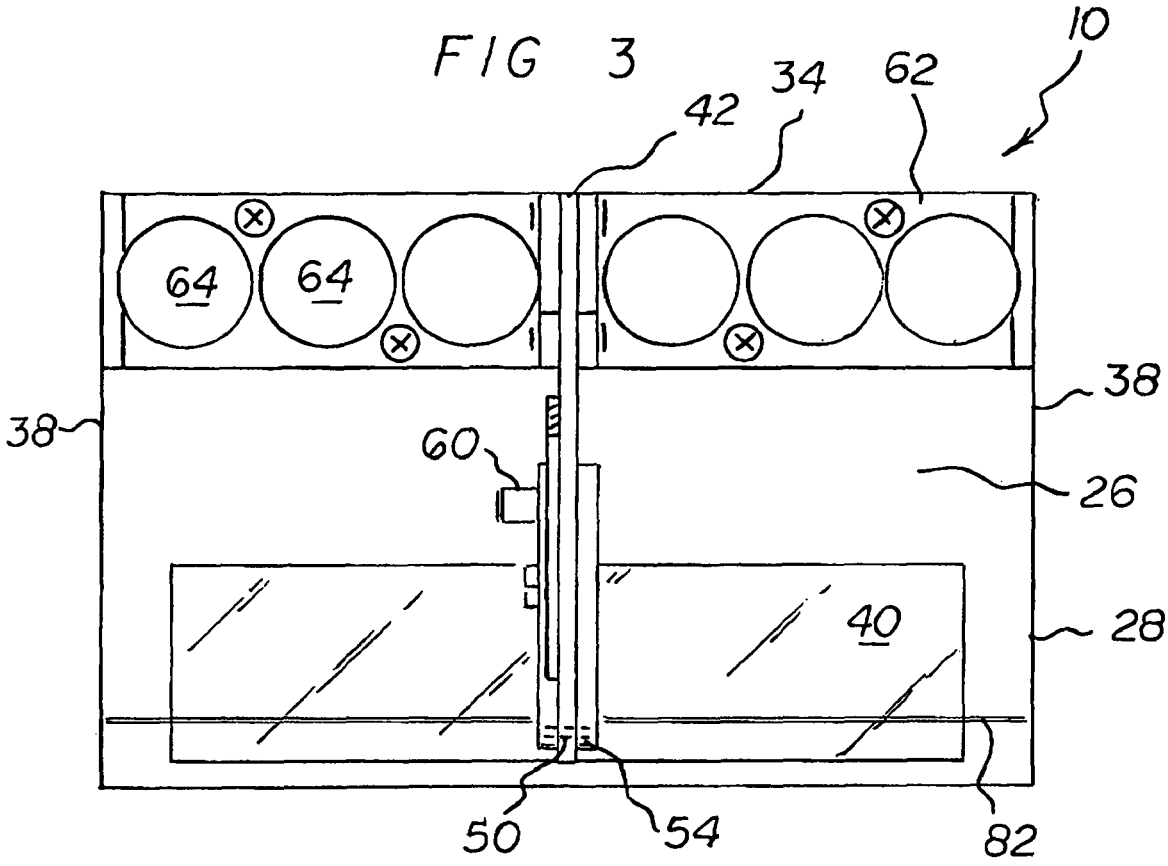
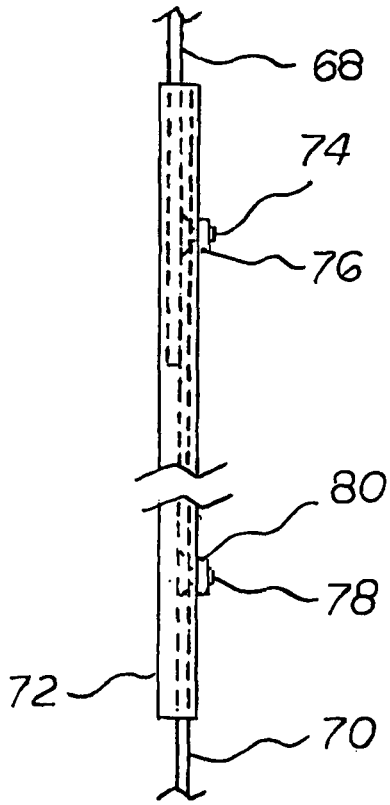
FIG 4

PUTTER SHAFT/HEAD DESIGNING SYSTEM

BACKGROUND OF THE INVENTION

1. Field of the Invention

The present invention relates to a putter shaft/head designing system and more particularly pertains to determining the preferred shaft length and angular orientation between a putter shaft and a head.

2. Description of the Prior Art

The use of putter designing systems of known designs and configurations is known in the prior art. More specifically, putter designing systems of known designs and configurations previously devised and utilized for the purpose of designing putters are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,875,293 issued Oct. 2, 1989 to Wakefield discloses a Golf Club Measuring Device. U.S. Pat. No. 5,884,409 issued Mar. 23, 1999 to Muldoon discloses an Apparatus for Determining and Adjusting Loft or Lie Angles of Golf Club. U.S. Pat. No. 6,363,620 issued Apr. 2, 2002 to Goodjohn discloses an Apparatus and Method for Measuring the Loft Angle and the Lie Angle of a Golf Club. Lastly, U.S. Pat. No. 7,164,473 issued Jan. 16, 2007 to Goodjohn discloses a Method and Apparatus for Measuring Face Angle.

While these devices fulfill their respective, particular objectives and requirements, the aforementioned patents do not describe a putter shaft/head designing system that allows determining the preferred shaft length and angular orientation between a putter shaft and a head.

In this respect, the putter shaft/head designing system according to the present invention substantially departs from the conventional concepts and designs of the prior art, and in doing so provides an apparatus primarily developed for the purpose of determining the preferred shaft length and angular orientation between a putter shaft and a head.

Therefore, it can be appreciated that there exists a continuing need for a new and improved putter shaft/head designing system which can be used for determining the preferred shaft length and angular orientation between a putter shaft and a head. In this regard, the present invention substantially fulfills this need.

SUMMARY OF THE INVENTION

In view of the foregoing disadvantages inherent in the known types of putter designing systems of known designs and configurations now present in the prior art, the present invention provides an improved putter shaft/head designing system. As such, the general purpose of the present invention, which will be described subsequently in greater detail, is to provide a new and improved putter shaft/head designing system and method which has all the advantages of the prior art and none of the disadvantages.

To attain this, the present invention essentially comprises a shaft with an upper end, a lower end, and an intermediate extent. The upper end has a grip for being held by a player.

A putter head simulator is provided. The simulator includes a horizontal lower plate. The lower plate has an upper surface and a lower surface. The lower plate also has a forwardly extending toe, a rearwardly extending heel, and opposed sides. A glass based mirror is attached to the upper surface of the lower plate. A vertical coupling plate extends upwardly from the upper surface of the lower plate parallel with and equally spaced from the sides.

An angular adjustment assembly is next provided for varying the angular relationship between the shaft and the simulator. The angular adjustment assembly includes the vertical coupling plate with a pie shaped cut out and an arcuate slot above and an axis aperture below. A shaft aperture extends through the lower end of the shaft. A pivot pin extends through the shaft aperture. The lower end of the shaft is thereby pivotable with respect to the coupling plate. A securement aperture extends through the shaft above the shaft aperture with a securement bolt extending through the securement aperture and the arcuate slot. The securement bolt has an associated angle nut for securing a proper angle between the shaft and the simulator. The coupling plate has horizontal components with apertures for weight reduction.

Lastly, a shaft length adjusting assembly is provided for varying the length of the shaft. The length adjusting assembly includes an upper linear component, a lower linear component, and a C-shaped joining component. The upper linear component constitutes an upper extent of the shaft. The lower linear component constitutes a lower extent of the shaft. An upper shaft bolt is coupled to the upper linear component and extends through the C-shaped component. An associated upper lengthening nut is provided. A lower shaft bolt is coupled to the lower linear component and extends through the C-shaped component. An associated lower lengthening nut is provided. The lengthening nuts are adapted to be loosened to vary the length of the shaft and then tightened at a preferred length to suit the player. The angle nut is adapted to be loosened to vary the angle of the shaft with respect to the simulator and then tightened at a preferred angle to suit the player. The mirror has a transverse line beneath the pivot pin for allowing the player to view his/her eyes while adjusting the length and angle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved putter shaft/head designing system which has all of the advantages of the prior art putter designing systems of known designs and configurations and none of the disadvantages.

It is another object of the present invention to provide a new and improved putter shaft/head designing system which may be easily and efficiently manufactured and marketed.

It is further object of the present invention to provide a new and improved putter shaft/head designing system which is of durable and reliable constructions.

An even further object of the present invention is to provide a new and improved putter shaft/head designing system which is susceptible of a low cost of manufacture with regard to both materials and labor, and which accordingly is then susceptible of low prices of sale to the consuming public, thereby making such putter shaft/head designing system economically available to the buying public.

Even still another object of the present invention is to provide a putter shaft/head designing system for determining the preferred shaft length and angular orientation between a putter shaft and a head.

Lastly, it is an object of the present invention to provide a new and improved putter shaft/head designing system having a shaft with upper and lower ends and an intermediate extent. A putter head simulator includes a horizontal lower plate having upper and lower surfaces, a mirror attached to the upper surface of the lower plate, and a vertical coupling plate extending upwardly from the upper surface of the lower plate. An angular adjustment assembly is for varying the angular relationship between the shaft and the simulator. A shaft length adjusting assembly is for varying the length of the shaft.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a putter shaft/head designing system constructed in accordance with the principles of the present invention.

FIG. 2 is a front elevational view of the lower portion of the system taken along line 2-2 of FIG. 1.

FIG. 3 is a cross sectional view taken along line 3-3 of FIG. 2.

FIG. 4 is a front elevational view taken along line 4-4 of FIG. 1.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved putter shaft/head designing system embodying the principles and concepts of the present invention and generally designated by the reference numeral 10 will be described.

The present invention, the putter shaft/head designing system 10 is comprised of a plurality of components. Such components in their broadest context include a shaft, a putter head, an angular adjustment assembly and a shaft length adjusting assembly. Such components are individually configured and correlated with respect to each other so as to attain the desired objective.

The putter shaft/head designing system 10 of the present invention is for determining the preferred shaft length and angular orientation between a shaft and a head. The designing is done of an accurate, reliable and economical manner. First provided is a shaft 14. The shaft has an upper end 16, a lower end 18, and an intermediate extent 20. The upper end has a grip 22 for being held by a player.

Next provided is a putter head simulator 26. The simulator includes a horizontal lower plate 28. The lower plate has an upper surface 30 and a lower surface 32. The lower plate also has a forwardly extending toe 34, a rearwardly extending heel 36, and opposed sides 38. A glass based mirror 40 is attached to the upper surface of the lower plate. A vertical coupling plate 42 extends upwardly from the upper surface of the lower plate parallel with and equally spaced from the sides.

An angular adjustment assembly is next provided for varying the angular relationship between the shaft and the simulator. The angular adjustment assembly includes the vertical coupling plate with a pie shaped cut out 46 and an arcuate slot 48 above and an axis aperture 50 below. A shaft aperture 52 extends through the lower end of the shaft. A pivot pin 54 extends through the shaft aperture. The lower end of the shaft is thereby pivotable with respect to the coupling plate. A securement aperture 56 extends through the shaft above the shaft aperture with a securement bolt 58 extending through the securement aperture and the arcuate slot. The securement bolt has an associated angle nut 60 for securing a proper angle between the shaft and the simulator. The coupling plate has horizontal components 62 with apertures 64 for weight reduction.

Lastly, a shaft length adjusting assembly is provided for varying the length of the shaft. The length adjusting assembly includes an upper linear component 68, a lower linear component 70, and a C-shaped joining component 72. The upper linear component constitutes an upper extent of the shaft. The lower linear component constitutes a lower extent of the shaft. An upper shaft bolt 74 is coupled to the upper linear component and extends through the C-shaped component. An associated upper lengthening nut 76 is provided. A lower shaft bolt 78 is coupled to the lower linear component and extends through the C-shaped component. An associated lower lengthening nut 80 is provided. The lengthening nuts are adapted to be loosened to vary the length of the shaft and then tightened at a preferred length to suit the player. The angle nut is adapted to be loosened to vary the angle of the shaft with respect to the simulator and then tightened at a preferred angle to suit the player. The mirror has a transverse line 82 beneath the pivot pin for allowing the player to view his/her eyes while adjusting the length and angle.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A putter shaft/head designing system comprising:

a shaft having upper and lower ends and an intermediate extent;

a putter head simulator including a horizontal lower plate having upper and lower surfaces, a mirror attached to the upper surface of the lower plate, a vertical coupling plate extending upwardly from the upper surface of the lower plate;

an angular adjustment assembly for varying the angular relationship between the shaft and the simulator, the angular adjustment assembly including the vertical coupling plate with a pie shaped cut out and an arcuate slot above and an axis aperture below, a shaft aperture extending through the lower end of the shaft with a pivot pin extending through the shaft aperture and pivotable with respect to the coupling plate, a securement aperture extending through the shaft above the shaft aperture with a securement bolt extending through the securement aperture and the arcuate slot, the securement bolt having an associated angle nut for securing a proper angle between the shaft and the simulator to suit a player; and a shaft length adjusting assembly for varying the length of the shaft, the system functioning to insure the positioning of a user's eyes directly over the head of the putter during use.

2. A putter shaft/head designing system comprising:

a shaft having upper and lower ends and an intermediate extent;

a putter head simulator including a horizontal lower plate having upper and lower surfaces, a mirror attached to the upper surface of the lower plate, a vertical coupling plate extending upwardly from the upper surface of the lower plate;

an angular adjustment assembly for varying the angular relationship between the shaft and the simulator; and a shaft length adjusting assembly for varying the length of the shaft, the system functioning to insure the positioning of a user's eyes directly over the head of the putter during use wherein the shaft length adjusting assembly includes an upper linear component and a lower linear component and a C-shaped joining component, the upper linear component constituting an upper extent of the shaft, the lower linear component constituting a lower extent of the shaft, an upper shaft bolt coupled to the upper linear component and extending through the C-shaped component with an associated upper lengthening nut, a lower shaft bolt coupled to the lower linear component and extending through the C-shaped component with an associated lower lengthening nut, the lengthening nuts adapted to be loosened to vary the length of the shaft and then tightened at a preferred length to suit a player.

3. A putter shaft/head designing system for determining the preferred shaft length and angular orientation between a shaft and a head, the system comprising, in combination:

a shaft having an upper end and a lower end and an intermediate extent, the upper end having a grip for being held by a player;

a putter head simulator, the simulator including a horizontal lower plate having an upper surface and a lower surface, the lower plate having a forwardly extending toe and a rearwardly extending heel, the lower plate having opposed sides, a glass based mirror attached to the upper surface of the lower plate, vertical coupling plate extending upwardly from the upper surface of the lower plate parallel with and equally spaced from the sides;

an angular adjustment assembly for varying the angular relationship between the shaft and the simulator, the angular adjustment assembly including the vertical coupling plate with a pie shaped cut out and an arcuate slot above and an axis aperture below, a shaft aperture extending through the lower end of the shaft with a pivot pin extending through the shaft aperture and pivotable with respect to the coupling plate, a securement aperture extending through the shaft above the shaft aperture with a securement bolt extending through the securement aperture and the arcuate slot, the securement bolt having an associated angle nut for securing a proper angle between the shaft and the simulator, the coupling plate having horizontal components with apertures for weight reduction; and a shaft length adjusting assembly for varying the length of the shaft, the length adjusting assembly including an upper linear component and a lower linear component and a C-shaped joining component, the upper linear component constituting an upper extent of the shaft, the lower linear component constituting a lower extent of the shaft, an upper shaft bolt coupled to the upper linear component and extending through the C-shaped component with an associated upper lengthening nut, a lower shaft bolt coupled to the lower linear component and extending through the C-shaped component with an associated lower lengthening nut, the lengthening nuts adapted to be loosened to vary the length of the shaft and then tightened at a preferred length to suit the player, the angle nut adapted to be loosened to vary the angle of the shaft with respect to the simulator and then tightened at a preferred angle to suit the player, the mirror having a transverse line beneath the pivot pin for allowing the player to view his/her eyes while adjusting the length and angle.

* * * * *